US005842638A

United States Patent [19]

Reents et al.

[11] Patent Number: 5,842,638

[45] Date of Patent: Dec. 1, 1998

[54] FLANGED SWIRL VALVE WITH RELIEVED ELASTOMER SEAL

[75] Inventors: Terry Reents, Burnsville; Wayne Bekius, Milaca, both of Minn.

[73] Assignee: Wagner Spray Tech Corporation, Minneapolis, Minn.

[21] Appl. No.: 878,084

[22] Filed: Jun. 18, 1997

[51] Int. Cl.[6] ..... B65D 63/00; B05B 1/34

[52] U.S. Cl. ..... 239/1; 239/332; 239/463; 239/600

[58] Field of Search ..... 239/1, 332, 463, 239/493, 600, DIG. 19; 277/936, 651, 531, 532

[56] References Cited

U.S. PATENT DOCUMENTS

| | | | |
|---|---|---|---|
| 1,340,136 | 5/1920 | Murphy | 239/463 |
| 2,580,668 | 1/1952 | Franz | 277/651 |
| 3,240,431 | 3/1966 | Hug et al. | 239/463 X |
| 3,746,262 | 7/1973 | Bete et al. | 239/463 X |
| 4,418,918 | 12/1983 | Nicoll | 277/531 X |
| 4,620,669 | 11/1986 | Polk | 239/332 X |
| 4,735,362 | 4/1988 | Trautwein et al. | 239/332 X |
| 4,744,516 | 5/1988 | Peterson et al. | 239/332 X |

*Primary Examiner*—Kevin Weldon
*Attorney, Agent, or Firm*—Faegre & Benson LLP

[57] ABSTRACT

An airless spray paint gun having an improved swirl valve which is less susceptible to erosion and reduces the amount of sputtering in the paint spray. The spray paint gun includes a gun assembly including a handle, a motor, and a switch for controlling the motor. A pump subassembly mounted to the gun assembly includes a pumping chamber having a discharge end with a beveled seat, a piston mounted within a pump housing and driven by the motor for pumping paint from the container through the discharge end of the pumping chamber, and a swirl valve mounted within the discharge end of the pumping housing. The swirl valve includes a valve body having first and second opposite sides, three paint swirl apertures extending through the valve body between the first and second opposite sides, an annular flange that radially projects from the valve body between the first and second sides, and a beveled seat-engaging surface on the second side of the valve body having an elastomeric material thereon co-molded with the valve body. The elastomeric material is softer than the material of the valve body. The flange is interposed between a spray tip and the discharge end of the pumping chamber and contacts the discharge end when the spray tip is mounted to the pump housing. The flange thus prevents excessive axial forces from being applied to the swirl valve, and thereby prevents cold flow and the plastic deformation of the elastomeric material while allowing the elastic deformation of the elastomeric material on the swirl valve. The elastomeric material is relieved in a cavity surrounding each swirl aperture to prevent migration of the elastomeric material into the swirl apertures.

26 Claims, 5 Drawing Sheets

22
32
24
31
14
46
44
16
36
37
38
39
62
64
18
12
78
60
52
54
10
20

FLANGED SWIRL VALVE WITH RELIEVED ELASTOMER SEAL

BACKGROUND OF THE INVENTION

1. Field of the Invention

The present invention relates generally to paint spray guns of the type including atomizing or swirl valves seated within an outlet chamber of a paint pump subassembly. In particular, the present invention relates to a paint spray gun with a swirl valve having a relieved elastomer seat-engaging surface integrally molded therewith and a radially projecting, annular flange.

2. Description of the Related Art

Airless paint spray guns, also sometimes known as cup guns, are generally known and in widespread use. Spray guns of this type are commercially available from Wagner Spray Tech corporation of Minneapolis Minn., the assignee of the present invention, and are disclosed in the Wagner U.S. Pat. No. 3,899,134 and the Soderlind et al. U.S. Pat. No. 4,036,438. These spray guns include a paint cup or container that is releasably mounted to a portable gun assembly which includes a pump subassembly and a spray tip. The gun assembly includes a handle with a trigger-type on/off switch, and a motor for driving a piston in the pump subassembly.

Pump subassemblies of the type shown in the Soderlind et al. patent referred to above include a pumping chamber connected to and supplying an outlet chamber. The piston is reciprocatingly driven within the pumping chamber by a linear motor. The pumping chamber is preferably fabricated of aluminum, stainless steel or another relatively hard and corrosion resistant metal. A replaceable poppet valve member is lightly spring biased into engagement with a valve seat at the inlet to the outlet chamber. A replaceable swirl valve having a beveled surface is located at a discharge end of the outlet chamber and is positioned adjacent an atomizing spray tip, with the beveled surface of the swirl valve engaging a beveled seat at an outlet of the outlet chamber to form a paint-tight seal between the swirl valve and the seat at the discharge end of the outlet chamber. A number of paint swirl apertures extend through the swirl valve to permit transmission of and impart a swirling momentum to paint or other material to be sprayed from the outlet chamber to the spray tip. In such prior art guns, the swirl valve was fabricated from a polymer such as nylon. When the spray gun is turned on by actuating the trigger, the motor drives the piston in the pump subassembly to draw paint from the container into the pumping chamber and thereafter move it to the outlet chamber where the paint is forced through the swirl valve apertures at high pressure and allowed to exit the gun via the atomizing spray tip, forming an atomized spray which may be directed to a surface desired to be painted by the operator of the gun.

Along with other parts which have been in contact with paint during operation, the swirl valve is typically removed and cleaned after each use of the spray gun. During reassembly, if the nut holding the spray tip is not tightly screwed onto the pump assembly and the swirl valve properly seated in the discharge end of the outlet chamber before the spray gun is reused, the high pressures developed within the outlet chamber of the pump subassembly can cause paint to flow between the surfaces of the swirl valve and the seat at the discharge end of the outlet chamber. If allowed to continue for a substantial length of time, this flow of paint may erode either or both the swirl valve and the beveled seat at the discharge end of the outlet chamber, which results in uneven and sputtering paint spray. If only the swirl valve is eroded, replacement of the swirl valve will restore proper operation of the spray gun. If the beveled seat is eroded, the pump subassembly must be placed.

One solution to the erosion problems associated with an under-tightened swirl valve is described in the co-pending and commonly assigned U.S. patent application Ser. No. 08/429,925, entitled "PAINT GUN WITH CO-MOLDED SWIRL VALVE." The swirl valve described in that application includes an elastomeric material that is co-molded to the beveled surface of the swirl valve. The elastomeric material is of a lesser hardness than the remainder of the swirl valve, and thereby forms a more resilient paint-tight seal between the swirl valve and the seat at the discharge end of the outlet chamber. This is true even if the nut holding the spray tip is not tightly screwed onto the pump subassembly, provided that the nut is secured sufficiently to engage the seat with the elastomer sealing surface.

Overtightening the nut holding the spray tip to the pump subassembly can also be problematic, however. In such a case, the co-molded elastomeric layer of a swirl valve such as that described above may be subject to cold flow, and thus may be permanently deformed, which in turn may cause one or two separate problems. First, the permanent deformation of the elastomeric material may allow paint to leak between the surfaces of the swirl valve and the seat at the discharge end of the outlet chamber, for example, during a subsequent, less-tight reassembly, which leaking, in turn, may erode both the swirl valve and the seat. The swirl valve and/or pump subassembly must then be replaced in order to restore proper operation of the gun. In addition, permanent deformation of the elastomeric material may migrate into the paint swirl apertures, partially or completely blocking the apertures, thus impairing the functioning of the spray gun.

There is, therefore, a continuing need for improved airless paint spray guns. In particular, there is a need for a spray gun having a swirl valve that creates an improved paint-tight seal when an operator either under or over-tightens the swirl valve against the seat of the pump subassembly. Such a swirl valve should also be less susceptible to erosion. The swirl valve should of course be efficient to manufacture and be easily cleanable after use. The ability to easily and efficiently retrofit existing spray guns is especially desirable. In addition, the swirl valve should also be less susceptible to blockage due to migration of the elastomeric material into the swirl apertures.

SUMMARY OF THE INVENTION

The swirl valve of the present invention can be efficiently manufactured and can be retrofitted into existing paint guns. The swirl valve of the present invention provides a more resilient paint tight seal in the paint gun and is less susceptible to erosion than prior art swirl valves, and thus reduces the potential for erosion and sputtering in the paint spray gun of the present invention.

One embodiment of the swirl valve of the present invention includes a valve body having first and second opposite sides, and formed of a material characterized by a first hardness value. One or more paint swirl apertures extend through the valve body between the first and second opposite sides. The first or outlet side of the valve body is a generally planar surface with a recess therein in communication with the swirl apertures. The second or inlet side of the valve body has a radially extending surface parallel to the planar surface of the first side and a cone-shaped or beveled surface radially outward of the radially extending surface and adapted to mate with a correspondingly beveled seating surface in the outlet chamber of the paint gun pump housing. The beveled surface of the swirl valve is preferably formed of an elastomeric material having a hardness less than that of the valve body, permitting a more resilient seating action than that achieved by conventional swirl valves. An axial stop projects from the swirl valve between the first side of the valve body and the beveled surface formed by the elastomeric material. In this embodiment, the axial stop is an annular flange. Upon installation in the paint gun, the flange is interposed between a spray tip and the pump housing of the spray gun and provides a positive axial stop for the spray tip with respect to the pump housing to prevent over-tightening of the spray tip. In this manner, the flange prevents cold flow and the plastic deformation of the elastomeric material, which in turn prevents leakage of paint in the paint gun and erosion of both the swirl valve and pump housing. In another embodiment of the swirl valve of the present invention, the co-molded sealing layer integral with the valve is relieved by having a cavity formed in the elastomeric material around each of the inlets to the swirl valve apertures to prevent the elastomeric material from cold flowing into and partially or fully obstructing the inlet of the aperture.

DETAILED DESCRIPTION OF THE PREFERRED EMBODIMENTS

Figure 1:
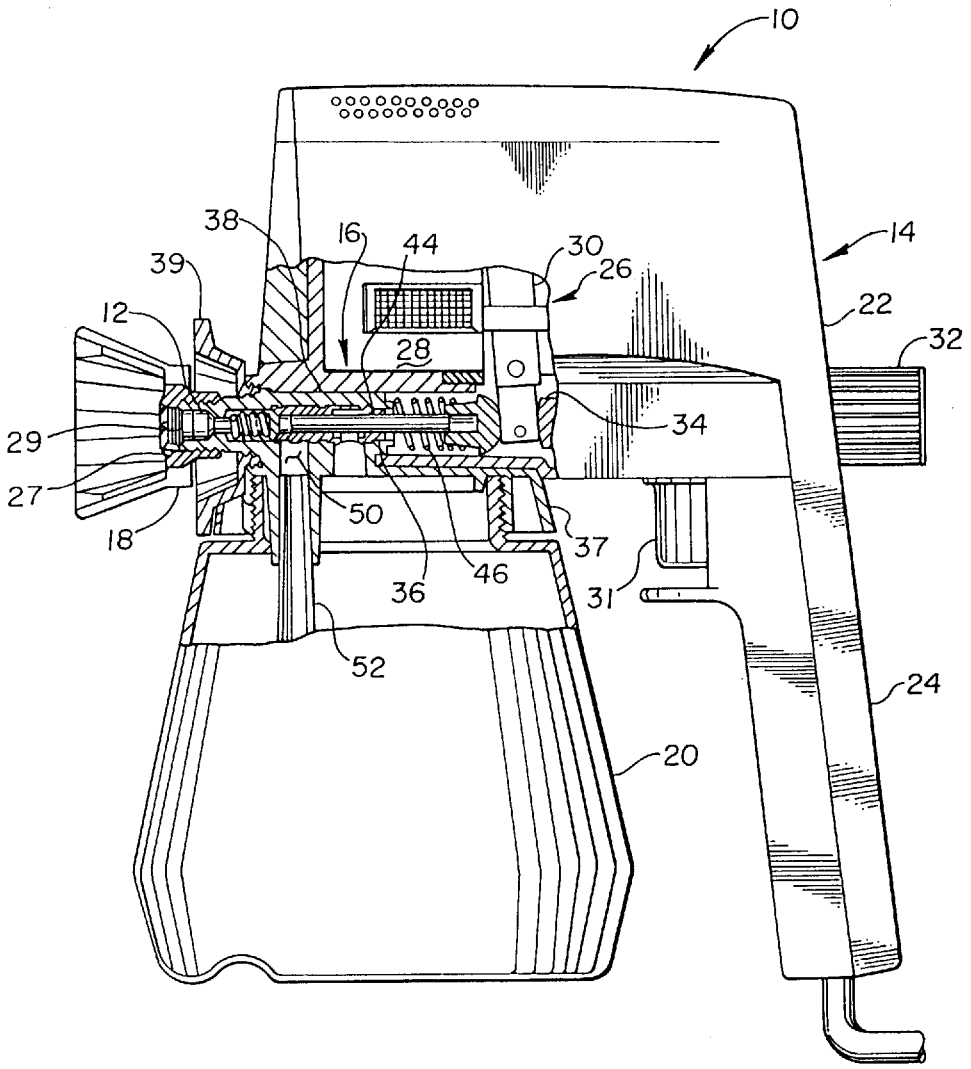
FIG. 1 is a side view of an assembly of a paint spray gun and a swirl valve useful in the practice of the present invention, with a pump subassembly shown in section.
Figure 2:
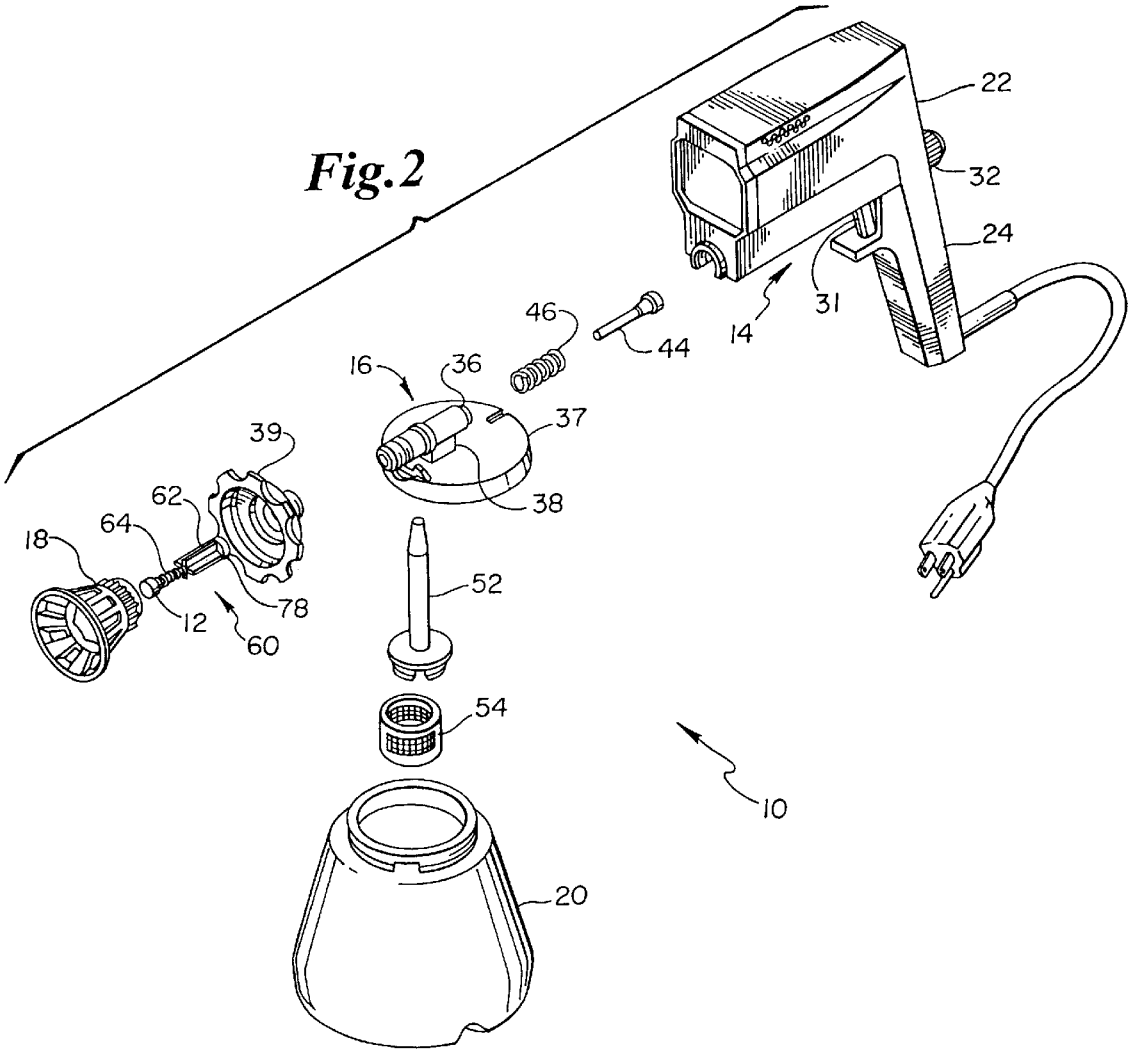
FIG. 2 is an exploded perspective view of the paint spray gun of the present invention shown in FIG. 1.

Referring now to the Figures, an airless cup-type paint spray gun 10 which includes a swirl valve 12 in accordance with the present invention is illustrated generally in FIGS. 1 and 2. Spray gun 10 includes a gun assembly 14, a pump subassembly 16, a spray tip 18 and paint cup or container 20. The gun assembly 14 includes a housing 22 and a handle 24 formed integrally therewith. A motor 26 is mounted within housing 22. Spray tip 18 includes a nut 27 and a nozzle 29 mounted therein. The spray gun 10 is actuated by a trigger-type on/off switch 31 in handle 24. Motor 26 can be a conventional oscillating armature type device which includes an electromagnet 28 driving an armature 30. The length of the swing of armature 30 is controlled by knob 32 to extend and retract stop 34 thus controlling the pattern of the spray produced by gun 10.

Figure 3:
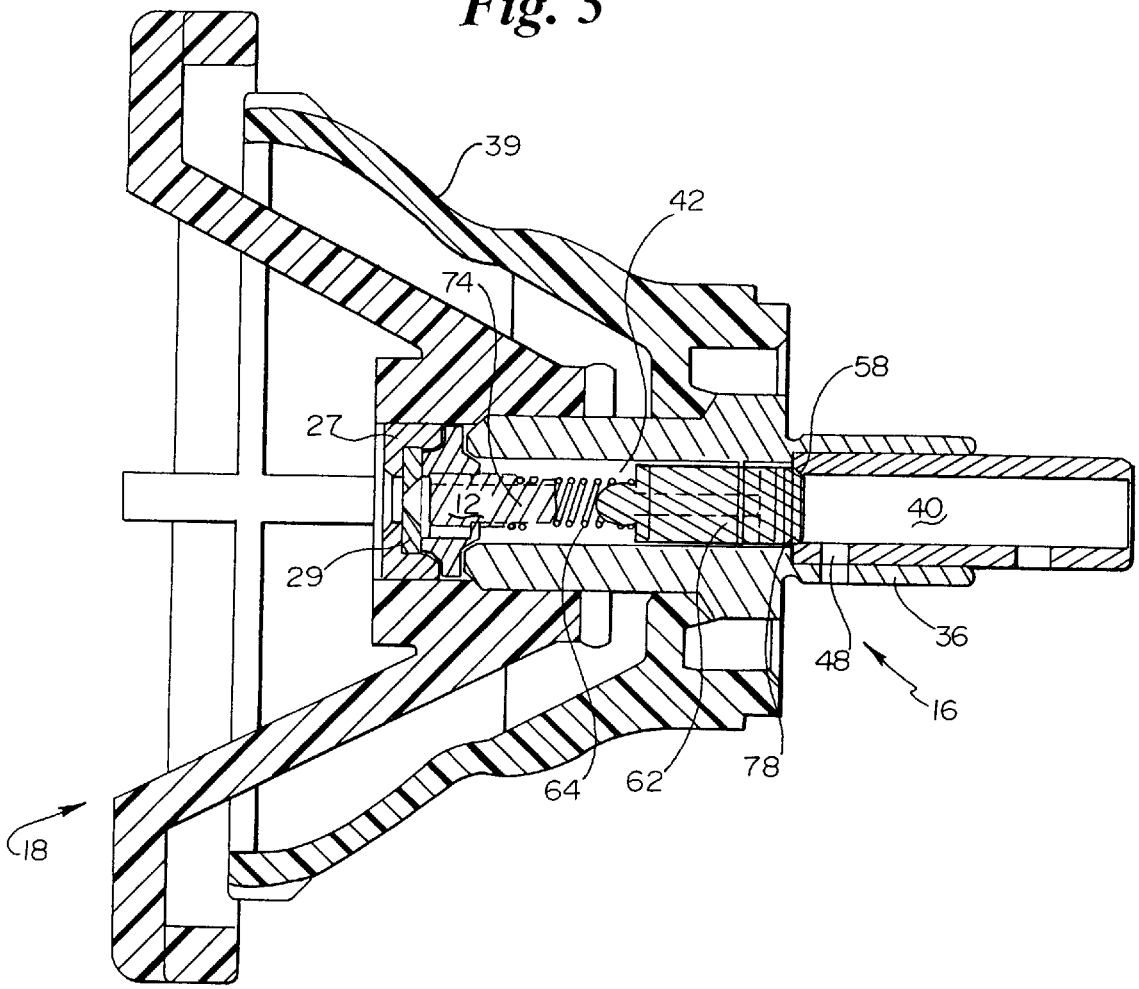
FIG. 3 is an enlarged partial section view of a paint pump subassembly and spray tip useful in the practice of this invention.

As shown in FIGS. 1–3, pump subassembly 16 includes a generally cylindrical pump housing 36 which is mounted to the upper surface of a paint container cover 37 by an integrally molded projection 38. The pump subassembly 16 and the cover 37 are removably secured to the gun assembly 14 by a nut 39. Pump housing 36 includes a pumping chamber 40 and an outlet chamber 42. Outlet chamber 42 includes a tapered or beveled seat 56 on its discharge end, and a tapered or beveled seat 58 on its inlet end. A poppet valve 62 having a beveled surface 78 and a spring 64 are positioned within output chamber 42. Spring 64 biases beveled surface 78 of poppet valve 62 into engagement with beveled seat 58 on the inlet end of pump housing 36. Piston 44 is mounted within pump housing 36 and is biased to a retracted position by spring 46. The cover 37 includes a paint-receiving chamber 50. An aperture 48 extends through pump housing 36 between pumping chamber 40 and paint-receiving chamber 50 in cover 37. A suction tube 52 extends from paint-receiving chamber 50 into a container 20, and has a filter 54 on its free end.

The operation of spray gun 10 is conventional in nature. When switch 31 is actuated to operate spray gun 10, motor 26 drives piston 44 through reciprocating paint-intake and output strokes. During paint intake strokes, spring 46 forces piston 44 in a rearward direction toward knob 32. A vacuum is thereby formed in the pumping chamber 40 of pump housing 36 since poppet valve 62 is biased into engagement with the seat 58. This vacuum causes paint from container 20 to be drawn into pumping chamber 40 through suction tube 52, paint-receiving chamber 50 and aperture 48 during the paint intake stroke. During the subsequent paint output stroke, piston 44 is driven by motor 26 in a forward direction toward spray tip 18. Forward motion of piston 44 forces the paint within paint pumping chamber 40 to unseat poppet valve 62 and flow into outlet chamber 42. By repeatedly delivering paint into the outlet chamber 42 in this manner, the paint is pressurized and forced through outlet chamber 42.

Figure 4:
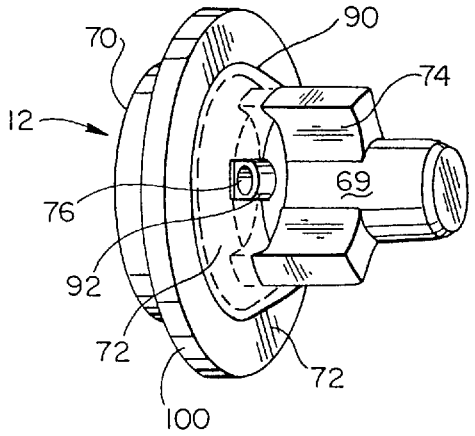
FIG. 4 is an enlarged perspective view of a swirl valve useful in the practice of the present invention.
Figure 5:
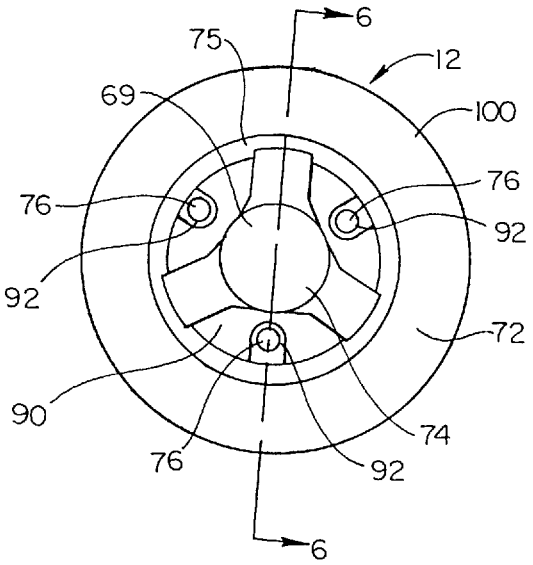
FIG. 5 is an end view of the inlet side of a swirl valve useful in the practice of the present invention.
Figure 6:
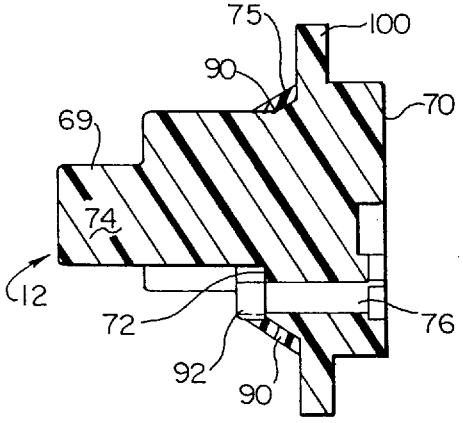
FIG. 6 is a section view of the swirl valve shown in FIG. 5 taken along line 6—6.

As best seen in FIGS. 4–6, a swirl valve 12 is positioned between spray tip 18 and the discharge end of outlet chamber 42, and receives the pressurized flow of paint. Swirl valve 12 includes a valve body 69 having a first or discharge side 70, a second or inlet side 72, and a spring projection 74 which extends from the inlet side 72 and engages spring 64. A plurality of swirl apertures 76 extend through the body of the swirl valve 12 to provide for fluid communication between inlet side 72 and discharge side 70, and to allow paint to flow through nozzle 29. An axial stop extends from valve body 69, and the axial stop is preferably an annular flange 100 that radially projects from valve body 69 between first side 70 and second side 72. Swirl valve 12 also includes a layer of elastomeric material 90, which has a beveled surface 75 that engages and mates with the beveled seat 56 on the discharge end of outlet chamber 42 (explained in greater detail below).

To reduce erosion or wear of swirl valve apertures 76 by the discharge of high pressure paint therethrough, the body of the swirl valve 12 is preferably fabricated from a polymer or other material which results in a relatively rigid and hard part when finished. Flange 100 is preferably formed from the same material as is used to form the body of swirl valve 12. In one embodiment, the body of the swirl valve 12 and flange 100 are molded from polypropylene which has a hardness value in the range of 80 to 100 durometer SHORE D. Elastomeric material layer 90, on the other hand, is relatively soft with respect to the material from which the body of the swirl valve 12 is fabricated. In one embodiment, elastomeric material layer 90 is also a layer of polypropylene which has a hardness value between 70–100 durometer SHORE D (but which is less than the specific durometer of the valve body).

Figure 8:
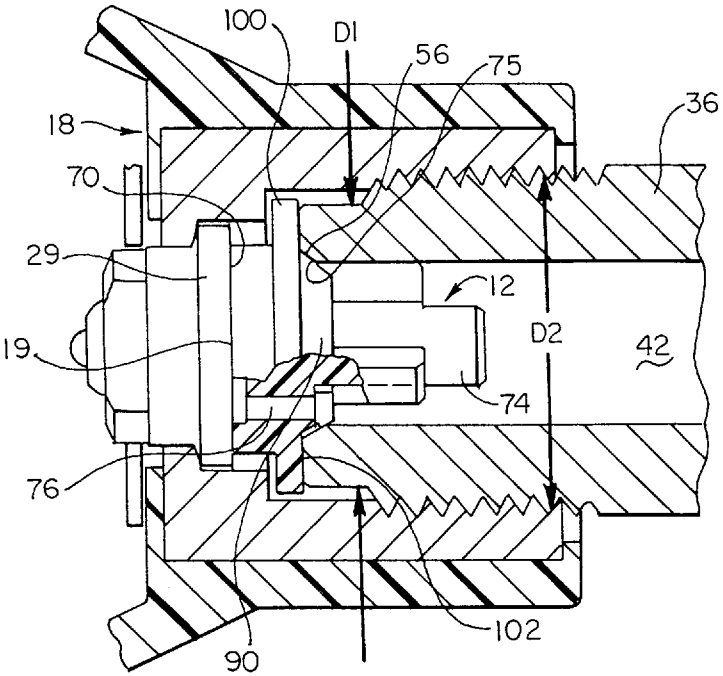
FIG. 8 is a view similar to that of FIG. 7 except with the spray tip tightened on the pump housing and the swirl valve providing a positive axial stop to prevent excessive deformation of the elastomeric material of the swirl valve.
Figure 7:
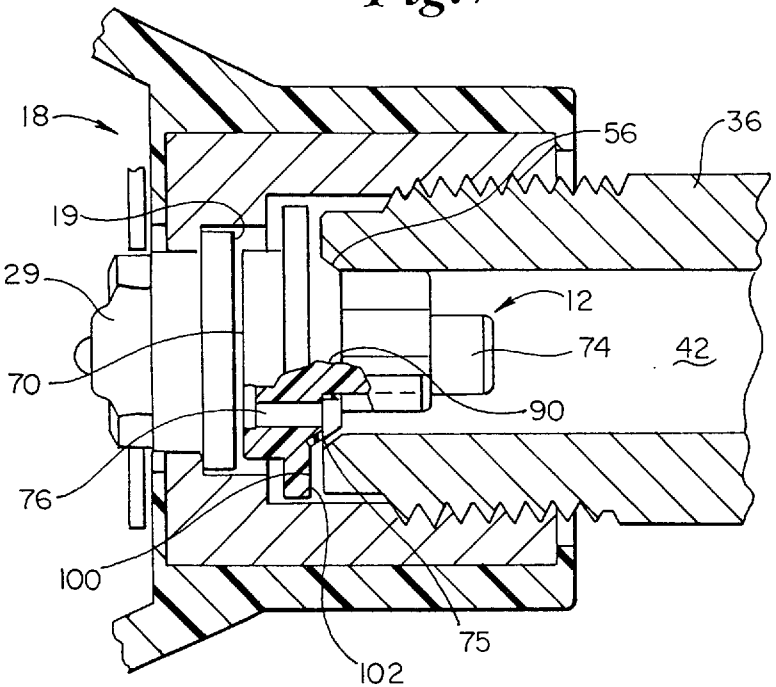
FIG. 7 is a fragmentary section view of a paint pump subassembly showing a swirl valve in accordance with the present invention spaced apart from the spray tip and pump housing.

Swirl valve 12 is releasably retained between spray tip 18 and outlet chamber 42 by nozzle 29 when the spray tip 18 is mounted to pump housing 36, and a paint tight seal is formed between the swirl valve 12 and the output chamber 42 by the engagement of beveled surface 75 of elastomeric layer 90 and seat 56. As best shown in FIGS. 7 and 8, spray tip 18 can be provided with threads that are adapted to engage threads on pump housing 36. As spray tip 18 is screwed onto pump housing 36, discharge side 70 of swirl valve 12 contacts an inner surface 19 of nozzle 29. In this manner, spray tip 18 provides an axial force on swirl valve 12 that urges beveled surface 75 of elastomeric material layer 90 against seat 56 of outlet chamber 42. Because elastomeric material layer 90 is formed from a softer material as compared to the body of swirl valve 12, elastomeric material layer 90 is elastically deformed to fill any voids or pits in seat 56, such as may be caused by erosion, as spray tip 18 continues to axially move against swirl valve 12. In this manner, a paint-tight seal between swirl valve 12 and seat 56 is formed.

As swirl valve 12 is urged toward outlet chamber 42, flange 100 of swirl valve 12 is interposed between spray tip 18 and the discharge end of outlet chamber 42. When spray tip 18 is mounted to pump housing 36, it is important not to over-tighten spray tip 18, insofar as excessive axial force on swirl valve 12 will provide excessive compression of elastomeric layer 90 as beveled surface 75 engages seat 56. Such excessive compression will cause permanent deformation of elastomeric layer 90, which in turn will create one or more paths between swirl valve 12 and the discharge end of outlet chamber 42 into which the pressurized paint will flow. Because of the abrasive nature of paint, paint flow between these parts will, over time, wear an erosion path in the parts, which will impair the functioning of spray gun 10. The interposition of flange 100 between spray tip 18 and the discharge end of outlet chamber 42 provides a positive axial stopping force as spray tip 18 is mounted to the pump housing 36 and prevents the over-compression of elastomeric layer 90. As best shown in FIG. 8, a surface 102 of flange 100 is urged against the discharge end of outlet chamber 42 as swirl valve 12 is urged toward outlet chamber 42. As spray tip 18 is further screwed onto pump housing 36, the engagement of surface 102 and the discharge end of outlet chamber 42 provides an axial stop, preventing over-compression of layer 90. In this manner, flange 100 allows elastomeric layer 90 to be elastically deformed a predetermined amount, but prevents the cold flow and permanent deformation of elastomeric layer 90 that could otherwise be caused by over-tightening spray tip 18.

Swirl valve 12 also includes cavities 92 that are formed in elastomeric layer 90. Cavities 92 surround each of the swirl apertures 76, thus relieving the elastomeric material around each of the apertures 76 to prevent the migration of elastomeric layer 90 into swirl apertures 76 as elastomeric layer 90 is deformed during installation of the swirl valve into the gun. Such migration would impede the flow of paint through the swirl apertures 76, thus impairing the functioning of spray gun 10. It is to be understood that although cavities 92 are shown as enlarged diameter cylindrical recesses, the cavities 92 may take any form suitable for preventing ingress of the elastomeric material into the apertures 76.

Known co-molding processes can be used to fabricate the swirl valve 12 with the elastomeric material layer 90 and beveled surface 75. One embodiment of the swirl valve 12 is fabricated by Barry Controls of 40 Guest Street, Brighton, Mass., using their Duo-Plexx process. Other vendors capable of the co-molding process include Phillips Plastics Corp. at 1233 International Drive, Eau Claire, Wis. and UFE Incorporated, of 1850 South Greeley Street, Stillwater, Minn.

It is to be understood that various plastics and hardness ranges may be utilized n the swirl valve of the present invention, provided that they are compatible with solvents used in the material to be sprayed (and in the cleanup afterward), and that they achieve the life and operating characteristics desired. For example, while polypropylene is preferred, polycarbonates, polyvinyl chloride and ABS all are compatible with polyurethane for the soft material. To accomplish the co-molding desired to produce the swirl valve having the desired soft layer on a hard body, injection molding machines having multiple barrels which enable simultaneous injection molding of two plastics may be employed. For example, such machines have been available from the Nissei Plastic Industrial Co. under model designations Two-Color DC Series 100–200 and 100–300.

In the preferred embodiments shown in FIGS. 4–8, first surface 70 of swirl valve 12 is generally circular, and has a diameter of about 8.5 millimeters, and the overall length of swirl valve 12 is 10.3 millimeters. Flange 100 is also generally circular, and has a diameter of 12.1 millimeters. The differential between the flange diameter and first surface diameter allows swirl valve 12 to be used with a variety of spray tips 18. Flange 100 is of sufficient thickness to provide an axial stop or gauge for a predetermined amount of compression or elastic deformation of layer 90. The predetermined compression for the embodiment shown is preferably about 1.4 millimeters. Elastomeric layer 90, which is co-molded onto second surface 72 of swirl valve 12, is preferably between 0.4 and 0.7 millimeters thick, and beveled surface or seal 75 is preferably inclined 30 degrees from the longitudinal axis of swirl valve 12. Beveled seat 56 on pump housing 36 is similarly preferably inclined 30 degrees from the longitudinal axis of pump housing 36, and thus uniformly engages surface 75 to form a paint tight sealing combination. Outlet chamber 42 is generally circular in cross section, and has an inner diameter of 7 millimeters that is generally constant along the length of outlet chamber 42. The outer diameter of pump housing 36 varies from a diameter D1 of 11 millimeters at the discharge end of pump housing 36 to a diameter D2 of 14 millimeters at the threaded portion of pump housing 36. Flange 100 is thus of sufficient diameter to contact the discharge end of the pump housing 36 without interfering with the mounting of spray tip 18 on pump housing 36.

A swirl valve 12 having flange 100 and the elastomeric material layer 90 in accordance with the present invention has considerable advantages over conventional swirl valves. In the present invention, the body of the swirl valve, and in particular the interior surface of the swirl apertures, is resistant to wear or erosion by the paint discharged, since it is fabricated from relatively hard material. The relatively soft elastomeric material that forms the sealing surface 75 facilitates a paint-tight seal with the seat 56 on the discharge end of the outlet chamber. Moreover, cavities 92 in layer 90 that surround each of the swirl apertures 76 prevent cold flow and migration of layer 90 into the apertures 76, and blockage of apertures 76 is thereby avoided. Finally, flange 100 prevents excessive compression of elastomeric layer 90 by providing an axial stop that prevents over-tightening of spray tip 18. In this manner, flange 100 prevents the permanent deformation of layer 90 and extends the life of the spray gun parts be preventing leakage of paint and erosion of the parts.

Although the present invention has been described with reference to preferred embodiments, those skilled in the art will recognize that changes can be made in form and detail without departing from the spirit and scope of the invention. The invention is not to be taken as limited to all of the details thereof as modifications and variations thereof may be made without departing from the spirit or scope of the invention. For example, and not by way of limitation, it may be desirable in one or more embodiments of the present invention to utilize the cavities surrounding the swirl apertures without the flange or stop in the valve body. Such an arrangement may, for example, be mandated by a need to retrofit improved swirl valves into existing paint gun assemblies not having clearance for the flange.

What is claimed is:

1. A swirl valve for mounting within a seat of a spray paint gun pump housing, comprising:

a valve body having first and second opposite sides, and formed of a material characterized by a first hardness value;

one or more paint swirl apertures extending through the valve body between the first and second opposite sides;

a seat-engaging surface projecting from the second side of the valve body;

elastomeric material on the seat-engaging surface of the valve body, the elastomeric material characterized by a second hardness value which is less than the first hardness value; and an axial stop positioned between the first and second sides of the valve body.

2. The swirl valve of claim 1 wherein the elastomeric material has a hardness between about 70 and 100 durometer.

3. The swirl valve of claim 1 wherein the valve body is formed of polypropylene.

4. The swirl valve of claim 1 wherein the valve body is formed of material having a hardness value between 80 and 100 durometer.

5. The swirl valve of claim 3 wherein the elastomeric material on the beveled surface has a hardness between about 70 and 100 durometer.

6. The swirl valve of claim 1 wherein the axial stop is an annular flange radially projecting from the valve body.

7. The swirl valve of claim 6 wherein the flange is further positioned between the first side of the valve body and the elastomeric material on the seat-engaging surface of the valve body.

8. The swirl valve of claim 1 wherein a cavity is formed in the elastomeric material surrounding an inlet end of each of the paint swirl apertures.

9. A swirl valve for a spray paint gun comprising:

a valve body having first and second opposite sides, and formed of a relatively hard material;

a plurality of paint swirl apertures extending through the valve body between the first and second opposite sides;

a seat-engaging surface on the second side of the valve body;

a relatively soft elastomeric material layer co-molded with the valve body to form a surface thereon; and an axial stop positioned between the first and second sides of the valve body.

10. The swirl valve of claim 9 wherein the elastomeric material has a hardness between about 70 and 100 durometer.

11. The swirl valve of claim 9 wherein the valve body is formed of polypropylene.

12. The swirl valve of claim 11 wherein the elastomeric material forming the beveled surface has a hardness between about 70 and 100 durometer.

13. The swirl valve of claim 9 wherein the axial stop is an annular flange radially projecting from the valve body.

14. The swirl valve of claim 13 wherein the flange is further positioned between the first surface of the valve body and the surface formed by the elastomeric material co-molded with the valve body.

15. The swirl valve of claim 9 wherein a cavity is formed in the elastomeric material surrounding each of the paint swirl apertures.

16. A swirl valve for mounting within a seat of a spray paint gun pump housing comprising:

a valve body having first and second opposite sides and formed of a material characterized by a first hardness value;

at least one passageway extending through the valve body between the first and second opposite sides for imparting a swirling momentum to a liquid passing through the passageway;

a seat-engaging surface on one of the first and second sides of the valve body;

a layer of elastomeric material bonded to the seat-engaging surface of the valve body, the elastomeric material characterized by a second hardness value which is less than the first hardness value; and a cavity formed in the elastomeric material surrounding the passageway sized to prevent migration of the elastomeric material into the passageway when the elastomeric material is compressed against the seat of the paint gun pump housing.

17. The swirl valve of claim 16 wherein the valve body has a plurality of passageways and cavities to swirl liquid passing through the valve body.

18. An improved swirl valve and airless spray paint gun assembly comprising:

a motor;

a paint container; and a pump subassembly including:

a pump housing in fluid communication with the paint container and having a beveled seat at a discharge end of the pump housing;

a piston mounted within the pump housing and driven by the motor for pumping paint from the container through the discharge end of the pumping housing; and a swirl valve mounted within the pump housing and including:

a valve body having first and second opposite sides, and formed of a material characterized by a first hardness value;

a plurality of paint swirl apertures extending through the valve body between the first and second opposite sides;

a layer of elastomeric material co-molded with the valve body and forming a beveled surface on the valve body, the elastomeric material characterized by a second hardness value which is less than the first hardness value; and an axial stop positioned between the first and second opposite sides of the valve body.

19. The improved swirl valve and airless spray paint gun of claim 18 wherein the elastomeric material comprises polypropylene having a hardness of about 70–100 durometer SHORE D.

20. The improved swirl valve and airless spray paint gun of claim 18 wherein the valve body is formed of polypropylene having a hardness of about 80–100 durometer SHORE D.

21. The improved swirl valve and airless spray paint gun of claim 18 wherein the axial stop is an annular flange radially projecting from the valve body.

22. The improved swirl valve and airless spray paint gun of claim 21 wherein the flange is further positioned between the first side of the valve body and the beveled surface formed by the elastomeric material co-molded with the valve body.

23. The improved swirl valve and airless spray paint gun of claim 22 further including a spray tip, wherein the flange is interposed between the spray tip and the discharge end of the pump housing.

24. The improved swirl valve and airless spray paint gun of claim 23 wherein a surface of the flange engages the discharge end of the pump housing as the spray tip is mounted to the pump housing, the surface of the flange engaging the discharge end in such a manner as to allow the elastic deformation of the elastomeric material while preventing the cold flow and plastic deformation of the elastomeric material.

25. The improved swirl valve and airless spray paint gun of claim 18 wherein a cavity is formed in the elastomeric material surrounding each of the paint swirl apertures.

26. A process for assembling an airless spray paint gun assembly comprising the steps of a) providing a pump housing having a beveled seat at a discharge end of the pump housing;

b) providing a spray tip;

c) providing a swirl valve within the pump housing, wherein the swirl valve includes:

i) a valve body having first and second opposite side, ii) a plurality of paint swirl apertures extending through the valve body between the first and second opposite side, iii) a layer of elastomeric material co-molded with the valve body and forming a beveled surface on the valve body, and iv) an axial stop positioned between the first side of the valve body and the beveled surface formed by the elastomeric material co-molded to the valve body; and d) engaging the spray tip with the pump housing so that the beveled surface of the swirl valve formed by the elastomeric material engages the beveled seat at the discharge end of the pump housing, wherein the axial stop of the swirl valve is interposed between the spray tip and the discharge end of the pump housing to contact the discharge end of the pump housing and prevent cold flow and plastic deformation of the elastomeric material.

* * * * *